US009334884B2

(12) United States Patent
Stuermer et al.

(10) Patent No.: US 9,334,884 B2
(45) Date of Patent: May 10, 2016

(54) HYDROSTATIC DRIVE SYSTEM

(71) Applicant: Linde Hydraulics GmbH & Co. KG, Aschaffenburg (DE)

(72) Inventors: Burkhard Stuermer, Kleinostheim (DE); Horst Tobias, Mespelbrunn (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 447 days.

(21) Appl. No.: 13/767,109

(22) Filed: Feb. 14, 2013

(65) Prior Publication Data

US 2013/0213030 A1 Aug. 22, 2013

(30) Foreign Application Priority Data

Feb. 16, 2012 (DE) ..... 10 2012 101 231

(51) Int. Cl.
*F15B 15/20* (2006.01)
*F15B 7/00* (2006.01)

(52) U.S. Cl.
CPC ..... *F15B 15/20* (2013.01); *F15B 7/006* (2013.01); *F15B 2211/20546* (2013.01); *F15B 2211/20561* (2013.01); *F15B 2211/27* (2013.01); *F15B 2211/5059* (2013.01); *F15B 2211/613* (2013.01)

(58) Field of Classification Search
CPC ..... F15B 2211/27; F15B 2211/20576; F15B 2211/6653; F15B 2211/6656; F15B 2211/613; F15B 15/20
See application file for complete search history.

(56) References Cited

U.S. PATENT DOCUMENTS 5,121,802 A * 6/1992 Rajala ..... E21B 44/06 173/1
5,419,132 A * 5/1995 Sato et al. ..... 60/468
6,389,953 B1 * 5/2002 Altman et al. ..... 91/515
6,732,813 B1 * 5/2004 Eklof ..... E21B 44/06 173/1

(Continued)

FOREIGN PATENT DOCUMENTS

EP 1588057 B1 4/2007

OTHER PUBLICATIONS

USA Standard Graphic Symbols for Fluid Power Diagrams (USAS y32.10-1967) 1967 The American Society of Mechanical Engineers p. 1-18.*

*Primary Examiner* — William A Rivera
*Assistant Examiner* — Richard Drake
(74) *Attorney, Agent, or Firm* — The Webb Law Firm

(57) ABSTRACT

A hydrostatic drive system includes a differential cylinder connected in a closed circuit to a high-pressure pump. A piston-side compression chamber and a piston-rod-side compression chamber of the differential cylinder are in communication with the high-pressure pump. The closed circuit includes a protection device having first and second protection valve devices that each includes a pressure relief valve and an anti-cavitation valve. The pressure relief valve of the first protection valve device is provided with an override device, by means of which the opening pressure of the pressure relief valve can be varied. When the high-pressure pump delivers into the piston-rod-side compression chamber, the pressure relief valve of the first protection valve device is adjusted by means of the override device to a reduced opening pressure and the differential volumetric flow flows out via the pressure relief valve to a low-pressure system.

7 Claims, 1 Drawing Sheet

(56) References Cited

U.S. PATENT DOCUMENTS 7,543,449 B2 * 6/2009 Ivantysynova et al. ..... 60/464
8,033,209 B2 * 10/2011 Jessen ..... A01B 63/1006 701/50
8,230,771 B2 * 7/2012 Bitter ..... A01D 41/145 60/477
2009/0031720 A1 * 2/2009 Son ..... E02F 3/963 60/420
2009/0236932 A1 * 9/2009 Matsubara ..... 310/309

* cited by examiner

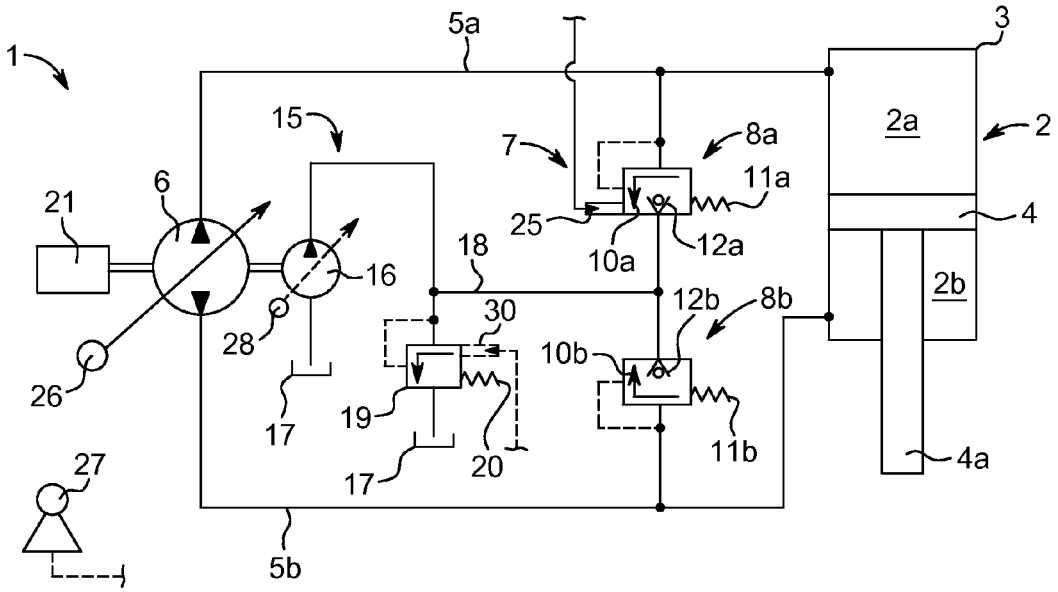
1
5a
3
2a
2
15
7
8a
11a
6
21
25
10a
12a
4
18
16
2b
12b
8b
30
28
10b
26
19
17
11b
4a
27
20
17
5b

HYDROSTATIC DRIVE SYSTEM

CROSS REFERENCE TO RELATED APPLICATION

This application claims priority to German Application No. 10 2012 101 231.8 filed Feb. 16, 2012, which is herein incorporated by reference in its entirety.

BACKGROUND OF THE INVENTION

1. Field of the Invention

This invention relates to a hydrostatic drive system with a user which is in the form of a differential cylinder and is connected in a closed circuit to a high-pressure pump. A piston-side compression chamber of the differential cylinder is in communication by means of a first power fluid line and a piston-rod-side compression chamber of the differential cylinder is in communication by means of a second power fluid line with the high-pressure pump. The closed circuit comprises a protection device which is formed by a first protection valve device that comprises a pressure relief valve and an anti-cavitation valve which is associated with the first power fluid line, and a second protection valve device which comprises a pressure relief valve and an anti-cavitation valve which is associated with the second power fluid line, which protection valve devices are connected with a low-pressure system.

2. Description of Related Art

For users that are operated in a closed circuit, a protection device is necessary which makes it possible to protect the user against excess pressure and cavitation. The protection device is thereby formed by protection valve devices which are associated with the respective power fluid lines, each of which protection valve devices has a pressure relief valve and an anti-cavitation valve that opens toward the associated power fluid line. The pressure relief valves protect the corresponding power fluid lines against excess pressure. The anti-cavitation valves perform a recharging function to prevent a cavitation in the associated power fluid line by feeding power fluid from the low-pressure system into the corresponding power fluid line.

When there is a movement of the piston, users in the form of differential cylinders have different volumes in the piston-side compression chamber and in the piston-rod-side compression chamber. If a differential cylinder of this type is connected in a closed circuit to a pump and is operated in both directions of movement, it must be guaranteed that when there is a movement of the piston of the differential cylinder, the differential volumetric flows that result from the different volumes of the piston-side compression chamber and the piston-rod-side compression chamber are equalized in the closed circuit.

EP 1 588 057 B1 describes a generic drive system in which, to equalize the differential volumetric flows of the differential cylinder operated in the closed circuit, in addition to a protection device that includes pressure relief and anti-cavitation valves, there are additional pilot-operated non-return valves in the closed circuit which connect the corresponding power fluid line of the closed circuit with a low-pressure system. The non-return valves are each actuated into an open position by the pressure in the opposite power fluid line. The non-return valve that opens toward the low-pressure-side power fluid line is, therefore, actuated into the open position by the high pressure of the closed circuit that is present in the high-pressure-side power fluid line to equalize the differential volumetric flow by feeding an additional volumetric flow from the low-pressure system into the corresponding low-pressure-side power fluid line of the closed circuit or by allowing the excess volumetric flow to flow out of the corresponding low-pressure-side power fluid line of the closed circuit into the low-pressure system.

However, additional pilot-operated non-return valves of this type increase the cost of construction and the space occupied by the drive system because additional valves are necessary for the equalization of the differential volumetric flows and in particular for the removal of the excess volumetric flow from the closed circuit.

SUMMARY OF THE INVENTION

An object of this invention is to provide a drive system of the general type described above but which makes it possible to equalize the differential volumetric flows with little construction effort or expense and low space requirements without additional valves.

The invention accomplishes this object by providing the pressure relief valve of the first protection valve device which is associated with the first power fluid line with an override device by means of which the opening pressure of the pressure relief valve can be adjusted between a protection pressure of the closed circuit and a reduced opening pressure. When the high-pressure pump is delivering into the piston-rod-side compression chamber, the pressure relief valve of the first protection valve device is set by means of the override device to the reduced opening pressure, and the differential volumetric flow flows out from the first power fluid line into the low-pressure system via the pressure relief valve. The invention, therefore, teaches that the pressure relief valve which is already present in the protection valve device associated with the first power fluid line is a pressure relief valve that can be adjusted in terms of opening pressure and actuated by means of the override device. With a pressure relief valve of this type that has a variable opening pressure, it is easily possible without additional valves, in an operating status in which the high-pressure pump is delivering into the piston-rod-side compression chamber of the differential cylinder and thus the second power fluid line forms the high-pressure side and the first power fluid line forms the low-pressure side of the closed circuit, to allow, by means of the override device, the excess volumetric flow to flow out of the piston-side compression chamber of the differential cylinder into the low-pressure system by means of the pressure relief valve of the protection valve device of the closed circuit, which is already present and which is set to the reduced opening pressure. All that is necessary on the pressure relief valve of the protection valve device of the first power fluid line which is already present is an override device that makes it possible to adjust and to switch the pressure relief valve between a protection pressure at which the differential cylinder and the closed circuit are protected against excess pressure and the reduced opening pressure. Compared to a drive system of the known art, the use of the pressure relief valve of the protection valve which is already present to remove the excess volumetric flow from the piston-side compression chamber of the differential cylinder requires less construction effort and less space for the equipment because no additional valves are required.

With a high-pressure pump that delivers into the piston-side compression chamber, the differential volumetric flow in the second power fluid line can be supplemented from the low-pressure system via the anti-cavitation valve of the second protection valve device which is associated with the second power fluid line. In an operating status in which the first power fluid line forms the high pressure side and the second power fluid line forms the low pressure side of the closed circuit, the volumetric flow to be supplemented in the low-pressure side can be supplemented via the anti-cavitation valve which is already present as part of the protection valve device which is associated with the second power fluid line. No additional modifications are, therefore, necessary to the protection valve device associated with the second power fluid line, because the feed function performed by the anti-cavitation valve of the protection valve device makes it possible to add to the differential volumetric flow.

The protection valve device is advantageously a combined pressure relief valve and an anti-cavitation valve. When combined pressure relief and anti-cavitation valves of this type are used as the protection valve device, the construction effort and the amount of space required by the drive system claimed by the invention can be further reduced.

In one advantageous embodiment of the invention, the low-pressure system has a low-pressure pump which operates in the open circuit and delivers into a delivery line, whereby a pressure protection device is associated with the delivery line. With a low-pressure system of this type, it is easily possible to make the volumetric flow to be supplemented in the closed circuit available by a corresponding actuation of the differential cylinder. The excess volumetric flow from the closed circuit with a corresponding actuation of the differential cylinder is removed into a reservoir via the pressure relief valve with the reduced opening pressure which is part of the protection valve device from the high pressure system formed by the closed circuit into the low-pressure system, and via the actuation of the pressure protection device of the low-pressure system which protects the low pressure in the low-pressure system.

It is particularly advantageous if the pressure relief valve can be adjusted by means of the override device to an opening pressure which is less than the protection pressure of the pressure protection device. In this manner, it is easily possible to remove the excess volumetric flow by a corresponding actuation of the differential cylinder from the closed circuit via the opened pressure protection device of the low-pressure system into a reservoir. The resulting pressure in the low-pressure-side power fluid line of the closed circuit makes it possible to safely operate the high-pressure pump of the closed circuit without suction pressure problems.

In one advantageous development of the invention, the pressure protection device of the low-pressure system is in the form of a pressure relief valve that can be varied in terms of protection pressure by means of an adjustment device. With a variable pressure relief valve of this type as the pressure protection device of the low-pressure system, it becomes easily possible, by lowering and reducing the protection pressure for the pressure protection device of the low-pressure system, to absorb the excess volumetric flow from the closed circuit in the event of a corresponding actuation of the differential cylinder with a small pressure difference and discharge it to the reservoir.

The override device of the pressure relief valve of the first protection valve device can be in the form of a hydraulic override device or an electrical override device. With an override device of this type, it is easily possible, in the corresponding operating status, to adjust the pressure relief valve to a reduced opening pressure to remove the excess volumetric flow from the closed circuit.

The adjustment device of the pressure protection device of the low-pressure system can be in the form of a hydraulic adjustment device or an electrical adjustment device. With an override device of this type it is easily possible, in the corresponding operating status, to adjust the pressure protection device of the low-pressure system to a reduced protection pressure to remove the excess volumetric flow from the closed circuit.

The low-pressure pump can be a pump with a constant displacement or delivery, in particular a gear pump. A fixed displacement pump of this type is easy and economical to design and build. If the pressure protection device of the low-pressure system can absorb the excess volumetric flow from the closed circuit with a low differential pressure or can be adjusted to a reduced protection pressure to remove the excess volumetric flow from the closed circuit, it becomes easily possible to prevent a pressure increase in the delivery line of the fixed displacement pump during the removal of the excess volumetric flow from the closed circuit, so that a simple and economical fixed displacement pump which is designed for the low pressure of the low-pressure system can be used.

In one advantageous development of the invention, the low-pressure pump is a variable displacement pump, the delivery of which can be adjusted and the delivery quantity of which is reduced when an excess volumetric flow is to be removed from the closed circuit. With a variable displacement pump of this type in the form of a low-pressure pump, the delivery quantity of which is reduced when there is an excess volumetric flow to be removed from the closed circuit, the volumetric flow flowing out via the pressure protection device of the low-pressure system can be minimized so that the construction effort and expense for the pressure protection device of the low-pressure system can be reduced.

Additional advantages and features of the invention are explained in greater detail below with reference to the exemplary embodiment illustrated in the accompanying schematic FIGURE, in which like reference numbers identify like parts throughout.

BRIEF DESCRIPTION OF THE DRAWING

The FIGURE depicts a schematic diagram of a hydrostatic drive system according to an embodiment of the present invention.

DESCRIPTION OF THE PREFERRED EMBODIMENTS

The accompanying FIGURE is a schematic diagram of a hydrostatic drive system 1 according to an embodiment of the invention. The drive system 1 comprises a differential cylinder 2 operated as a consumer in the closed circuit. The differential cylinder 2 includes a piston 4 which can be displaced longitudinally in a housing 3, whereby the piston 4 is provided on one side with a piston rod 4*a*.

The differential cylinder 2 has a piston-side compression chamber 2*a* which is connected by means of a first power fluid line 5*a* to a high-pressure pump 6, and a piston-rod-side compression chamber 2*b* which is connected by means of a second power fluid line 5*b* to the high-pressure pump 6. The compression chambers 2*a*, 2*b* of the differential cylinder 2 have different volumes on account of the piston rod 4*a* which is located in the piston-rod-side compression chamber 2*b*.

The closed circuit, which is formed by the power fluid lines 5*a*, 5*b* and which forms a high-pressure system, comprises a protection device 7 which is formed by a first protection valve device 8*a* which is associated with the first power fluid line 5*a* and by a second protection valve device 8*b* which is associated with the second power fluid line 5*b*.

The first protection valve device 8*a* includes a pressure relief valve 10*a* which is set to a protection pressure that protects the high pressure of the closed circuit and which can be actuated into an open position by the pressure present in the first power fluid line 5*a*. The protection valve device 8*a* further includes an anti-cavitation valve 12*a*, such as a non-return valve, for example, which opens toward the first power fluid line 5*a*. In the illustrated exemplary embodiment, the pressure relief valve 10*a* is set by means of a spring device 11*a* to the protection pressure of the closed circuit and, therefore, of the high-pressure system.

Accordingly, the second protection valve device 8*b* includes a pressure relief valve 10*b* which is set to a protection pressure that protects the high pressure of the closed circuit and can be actuated into an open position by the pressure present in the second pressure line 5*b*. The protection valve device 8*b* further includes an anti-cavitation valve 12*b* such as a non-return valve which opens toward the second power fluid line 5*b*. In the illustrated exemplary embodiment, the pressure relief valve 10*b* is set by means of a spring device 11*b* to the protection pressure of the closed circuit and, therefore, of the high-pressure system.

The protection valves 8*a*, 8*b* are, in this case, in the form of combined pressure relief and anti-cavitation valves which are connected with the corresponding power fluid lines 5*a*, 5*b* and a low-pressure system 15.

The low-pressure system 15, which forms a feed pressure circuit of the high-pressure system which is formed by the closed circuit, has a low-pressure pump 16 which is operated in the open circuit, and which draws in power fluid from a reservoir 17 and delivers into a delivery line 18 to which the protection valves 8*a*, 8*b* are connected. For the protection of the low-pressure system 15, a pressure protection device 19 connected with the reservoir 17 is associated with the delivery line 18, whereby the protection pressure that protects the low pressure is defined by a spring device 20.

A drive machine 21, such as an internal combustion engine, for example, is provided to drive the high-pressure pump 6 and the low-pressure pump 16.

The invention teaches that the pressure relief valve 10*a* of the first protection valve device 8*a* is provided with an override device 25 by means of which the pressure relief valve 10*a* can be adjusted between the protection pressure of the closed circuit and a reduced opening pressure at which it can be actuated. In the illustrated exemplary embodiment, the opening pressure of the pressure relief valve 10*a* can be reduced from the protection pressure to the reduced opening pressure by means of the override device 25. The pressure relief valve can preferably be reduced by means of the override device 25 from the protection pressure of the closed circuit, which is realized in the form of a high-pressure system and the protection pressure of which is defined by the spring device 11*a*, to an opening pressure that lies below the protection pressure of the pressure protection device 19 of the low-pressure system defined by the spring device 20.

The pressure relief valve 10*a* can preferably be switched by means of the override device 25 between the protection pressure defined by the spring device 11*a* of the high-pressure system with an actuation of the override device 25 to the reduced opening pressure.

The high-pressure pump 6 of the closed circuit is in the form of a variable displacement pump, for example an axial piston machine with a swashplate construction. An adjustment device that controls the displacement can be actuated by means of an actuator device 26.

For the actuation of the drive system 1, a control element 27, such as a joystick, for example, is provided which, when it is actuated, actuates the actuator device 26 so that the desired direction and speed of movement of the differential cylinder 2 can be achieved by delivering a corresponding delivery flow into the power fluid line 5*a* or 5*b*.

The low-pressure pump 16 of the low-pressure system 15 can be a constant-displacement pump, such as a gear pump, for example. Alternatively, the low-pressure pump 16 can be in the form of a variable displacement pump, for example an axial piston machine with a swashplate construction, whereby an adjustment device that controls the displacement can be actuated by means of an actuator device 28 as a function of the actuation of the control element 27.

In one development of the invention, the pressure protection device 19 of the low-pressure system 15 can be in the form of a pressure relief valve, the protection pressure of which can be adjusted by means of an adjustment device 30. By means of the adjustment device 30, the pressure protection device 19 can be adjusted or switched from the protection pressure of the low-pressure system defined by the spring device 20 to a reduced opening pressure.

The override device 25 of the pressure relief valve 10*a* and the adjustment valve 30 of the pressure protection device 19 that is optionally present can advantageously be actuated as a function of the actuation of the control element 27.

When the control element 27 is actuated to extend the piston rod 4*a* of the differential cylinder 2, the actuator device 26 of the adjustment device 30 of the high-pressure pump 6 is actuated so that the high-pressure pump 6 delivers into the first power fluid line 5*a* and, thus, into the piston-side compression chamber 2*a* of the differential cylinder 2. The first power fluid line 5*a*, therefore, forms the high-pressure side and the second power fluid line 5*b* forms the low-pressure side of the closed circuit. The override device 25 of the pressure relief valve 10*a* and the optional adjustment device 30 of the pressure protection device 19 are not actuated, so that the pressure relief valve 10*a* is moved into the closed position by the spring device 11*a* at the protection pressure of the high-pressure system formed by the closed circuit. The pressure protection device 19 is moved into the closed position by means of the spring device 20 at the protection pressure of the low-pressure system 15.

In the low-pressure-side second power fluid line 5*b*, the required differential volumetric flow is fed and supplemented from the low-pressure system 15 via the opening anti-cavitation valve 12*b* of the protection valve device 8*b* which is associated with the second power fluid line 5*b*.

When the control element 27 is actuated to retract the piston rod 4*a* of the differential cylinder 2, the actuator device 26 of the adjustment device 30 of the high-pressure pump 6 is actuated so that the high-pressure pump 6 delivers into the second power fluid line 5*b* and, thus, into the piston-rod-side compression chamber 2*b* of the differential cylinder 2. The second power fluid line 5*b*, therefore, forms the high-pressure side and the first power fluid line 5*a* forms the low-pressure side of the closed circuit. The invention teaches that the override device 25 of the pressure relief valve 10*a* of the low-pressure side first power fluid line 5*a* is actuated and, thus, the pressure relief valve 10*a* is set to a reduced opening pressure. The opening pressure and, thus, the response pressure of the pressure relief valve 10*a* is thereby lowered by means of the override device 25 so that the excess differential volumetric flow in the first power fluid line 5*a* is diverted into the reservoir 17 and discharged via the opening pressure relief valve 10*a* of the first protection valve device 8*a* into the low-pressure system 15 and the opening pressure protection device 19 of the low-pressure system.

A pressure is thereby established in the low-pressure-side first power fluid line 5*a* at which the high-pressure pump 6 working in the closed circuit can operate without suction problems.

With a low-pressure pump 16 in the form of a fixed displacement pump, the differential volumetric flow rate of the closed circuit and the delivery flow provided by the low-pressure pump thereby flows to the reservoir 17 via the pressure protection device 19 which is opened. The pressure protection device 19 is advantageously designed and provided with a volumetric flow rate such that the additional differential volumetric flow rate of the closed circuit can be absorbed with a small pressure difference and discharged to the reservoir. If the protection pressure of the pressure protection device 19 can be varied by means of the adjustment device 30, in an operating condition for the refraction of the piston rod 4*a* by an actuation of the adjustment device 30, the pressure protection device 19 is adjusted or switched to a reduced opening pressure, as a result of which the additional differential volumetric flow from the low-pressure-side power fluid line 5*a* of the closed circuit can also be discharged to the reservoir 17 with a small pressure difference. As a result, the low-pressure pump 16 can be in the form of a simply constructed gear pump which need only be designed to the pressure level of the low-pressure system 15.

If the low-pressure pump 16 is in the form of a variable displacement pump with a variable delivery, in an operating condition for the retraction of the piston rod 4*a*, the delivery of the low-pressure pump 16 can be reduced by an actuation of the actuator device 28, so that the volumetric flow formed by the delivery flow of the low pressure pump 16 flowing out via the opening pressure protection device 19 to the reservoir and the additional differential volume flow from the low-pressure-side power fluid line 5*a* of the closed circuit can be minimized.

The invention makes it possible, by means of the override device 25 to build the pressure relief valve 10*a* which is already present, to realize the first protection valve device 8*a* which is necessary for the operation of the closed circuit, in the form of a high-pressure relief valve that has a variable and progressive opening pressure, so that the differential volumetric flow can be discharged without additional valves and thus with little construction effort and requiring little room from the low-pressure side of the closed circuit.

The invention is not limited to the exemplary embodiment illustrated in the accompanying FIGURE.

Instead of a reduction of the opening pressure of the pressure relief valve 10*a* in the event of an actuation of the override device 25, when the pressure relief valve 10*a* is actuated, the pressure relief valve 10*a* can be set to a higher pressure, starting from the reduced opening pressure to the protection pressure of the closed circuit. A pressure relief valve 10*a* of this type is set by the spring device 11*a* to the reduced operating pressure and can be set to a higher pressure by the actuator device 25 to the protection pressure. With a pressure relief valve 10*a* of this type, to extend the piston rod 4*a* of the differential cylinder 2, the override device 25 is actuated to achieve the high protection pressure, and for the retraction of the piston rod 4*a* of the differential cylinder 2, the actuator device is not actuated, to achieve the adjustment of the pressure relief valve 10*a* to the reduced opening pressure.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic drive system, comprising:

a user comprising a differential cylinder connected in a closed circuit to a high-pressure pump, in which a piston-side compression chamber of the differential cylinder is in communication with the high-pressure pump by a first power fluid line, and a piston-rod-side compression chamber of the differential cylinder is in communication with the high-pressure pump by a second power fluid line, wherein the closed circuit comprises a protection device comprising a first protection valve device that comprises a pressure relief valve and an anti-cavitation valve which is associated with the first power fluid line, and a second protection valve device which comprises a pressure relief valve and an anti-cavitation valve which is associated with the second power fluid line, wherein the protection valve devices are connected with a low-pressure system, and wherein the pressure relief valve of the first protection valve device associated with the first power fluid line includes an override device by means of which an opening pressure of the pressure relief valve is varied between a protection pressure of the closed circuit and a reduced opening pressure, whereby when the high-pressure pump delivers into the piston-rod-side compression chamber, the pressure relief valve of the first protection valve device is adjusted by the override device to the reduced opening pressure due to an actuation of a control element controlling an actuation of the user, and a differential volumetric flow flows out via the pressure relief valve from the first power fluid line into the low-pressure system, and the pressure relief valves of the first protection valve device and the second protection valve device have a protecting pressure that protects a high pressure of the closed circuit, wherein the low-pressure system has a low-pressure pump that is operated in the open circuit and delivers into a delivery line, and a pressure protection device is associated with the delivery line, wherein the pressure protection device of the low-pressure system is a pressure relief valve, the protection pressure of which is varied by an adjustment device, wherein the override device of the pressure relief valve and the adjustment device of the pressure protection valve are actuated as a function of the actuation of the control element.

2. The hydrostatic drive system as claimed in claim 1, wherein when the high-pressure pump delivers into the piston-side compression chamber, the differential volumetric flow in the second power fluid line is supplemented from the low-pressure system via the anti-cavitation valve of the protection valve device which is associated with the second power fluid line.

3. The hydrostatic drive system as claimed in claim 1, wherein each protection valve device comprises a combined pressure relief and anti-cavitation valve.

4. The hydrostatic drive system as claimed in claim 1, wherein the pressure relief valve of the first protection valve device is adjusted by the override device to an opening pressure which is below the protection pressure of the pressure protection device.

5. The hydrostatic drive system as claimed in claim 1, wherein the override device is a hydraulic override device or an electrical override device.

6. The hydrostatic drive system as claimed in claim 1, wherein the adjustment device is a hydraulic adjustment device or an electrical adjustment device.

7. The hydrostatic drive system as claimed in claim 1, wherein the low-pressure pump is a variable displacement pump, the delivery of which is adjustable, and the delivery of which is reduced in the event of an excess volumetric flow to be removed from the closed circuit.

* * * * *